United States Patent [19]

Kranefeld et al.

[11] 4,057,942

[45] Nov. 15, 1977

[54] TELESCOPIC BOOM WITH HYDRAULIC ACTUATING MECHANISM

[75] Inventors: Wilhelm Kranefeld, Wetter; Helmut Schneider, Kamen-Methler, both of Germany

[73] Assignee: O & K Orenstein & Koppel Aktiengesellschaft, Berlin, Germany

[21] Appl. No.: 682,645

[22] Filed: May 3, 1976

[30] Foreign Application Priority Data

May 2, 1975 Germany ..... 2519558

[51] Int. Cl.[2] ..... B66C 23/04

[52] U.S. Cl. ..... 52/115; 52/118; 212/144; 214/141; 254/108

[58] Field of Search ..... 212/144, 59 R; 214/141; 254/108; 52/111, 115, 117, 118; 91/167 R, 169; 92/51, 52, 53

[56] References Cited

U.S. PATENT DOCUMENTS

| | | | |
|---|---|---|---|
| 2,746,612 | 5/1956 | Wirz | 212/59 R |
| 3,368,696 | 2/1968 | Johnston et al. | 212/59 R |
| 3,386,594 | 6/1968 | Grove | 212/55 |
| 3,398,645 | 8/1968 | Nansel | 52/115 X |
| 3,471,034 | 10/1969 | Shinohaya | 212/59 R |
| 3,481,581 | 12/1969 | Sunseri | 254/108 |
| 3,620,379 | 11/1971 | Fauchere | 212/144 |
| 3,670,465 | 6/1972 | Cheze | 52/115 |
| 3,721,054 | 3/1973 | Hornagold | 52/118 |
| 3,963,127 | 6/1976 | Eriksson | 212/144 |

FOREIGN PATENT DOCUMENTS

| | | | |
|---|---|---|---|
| 242,233 | 1/1964 | Netherlands | 254/108 |

*Primary Examiner*—Leslie Braun
*Attorney, Agent, or Firm*—Walter Becker

[57] ABSTRACT

A telescopic boom for movable cranes with at least one hydraulically operable telescopic slide and with at least one mechanically operable telescopic slide. The pushing out movement and the retracting movement of the mechanically actuated telescopic slide is effected by means of a holding bar having a free end portion provided with a pressing or pushing member and with a pulling member offset by 180° with regard to the pressing or pushing member. The other end of the holding bar is provided with a transverse bolt for engagement with a bearing on the at least one hydraulically operable slide. The mechanically operable telescopic slide is provided with cams extending transverse to its longitudinal direction of movement for cooperation with the holding bar.

3 Claims, 12 Drawing Figures

TELESCOPIC BOOM WITH HYDRAULIC ACTUATING MECHANISM

The present invention relates to a telescopic boom for movable cranes with one or more hydraulically operated telescopic slides and with one or more mechanically operated telescopic slides, the expanding and retracting movement of the mechanically operated telescopic slides being effected by means of a holding bar.

With a heretofore known telescopic boom arranged on a movable crane, the outward movement of the mechanically operated slide provided in addition to the hydraulically operated telescopic slides is effected by means of a bar the length of which corresponds to the length of the part or parts to be moved outwardly. This means, however, that the bar with two or more telescopic parts to be moved outwardly mechanically will, with regard to the high occurring buckling stresses, become so heavy that it can no longer be actuated by one operator alone. In other words, either an additional operator is needed or a hoisting mechanism must be used. The same awkward handling is repeated when retracting the telescopic slide. Furthermore, the mounting of the long and heavy bar causes difficulties.

It is, therefore, an object of the present invention to provide an arrangement which will do with a short holding bar to be provided between the hydraulically and the mechanically operated telescopic slides while the length of the short holding bar amounts to only a partial stroke of the telescopic slides, and while the short holding bar, due to its light weight, can during the outward and inward movement of the slides be actuated without difficulties by only one operator.

This object and other objects and advantages of the invention will appear more clearly from the following specification in connection with the accompanying drawings, in which.

The telescopic boom according to the present invention is characterized primarily in that the mechanically operated telescopic slide is provided with dovetailed cams which are arranged transverse to the direction of actuation of the telescopic slide, and is furthermore characterized in that the holding bar is provided at one end with a bolt passing transverse through the holding bar whereas its other end is provided with a pressure member and with a pulling member the shape of which is adapted to that of the cam, the pressure member and the pulling member being offset relative to each other by 180°.

Figure 3:
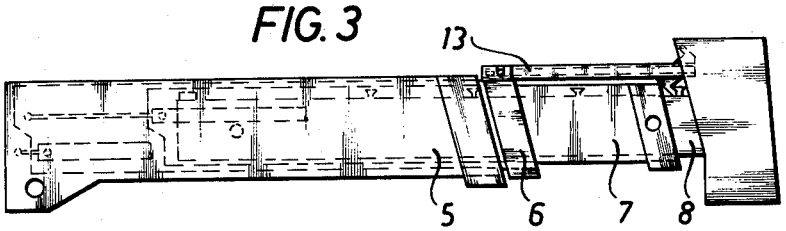
FIG. 3 shows the hydraulic outward movement of a telescopic slide and the mounting of the holding bar to make possible the retraction of the outer hydraulically operated slide.
Figures 10, 11, 12:
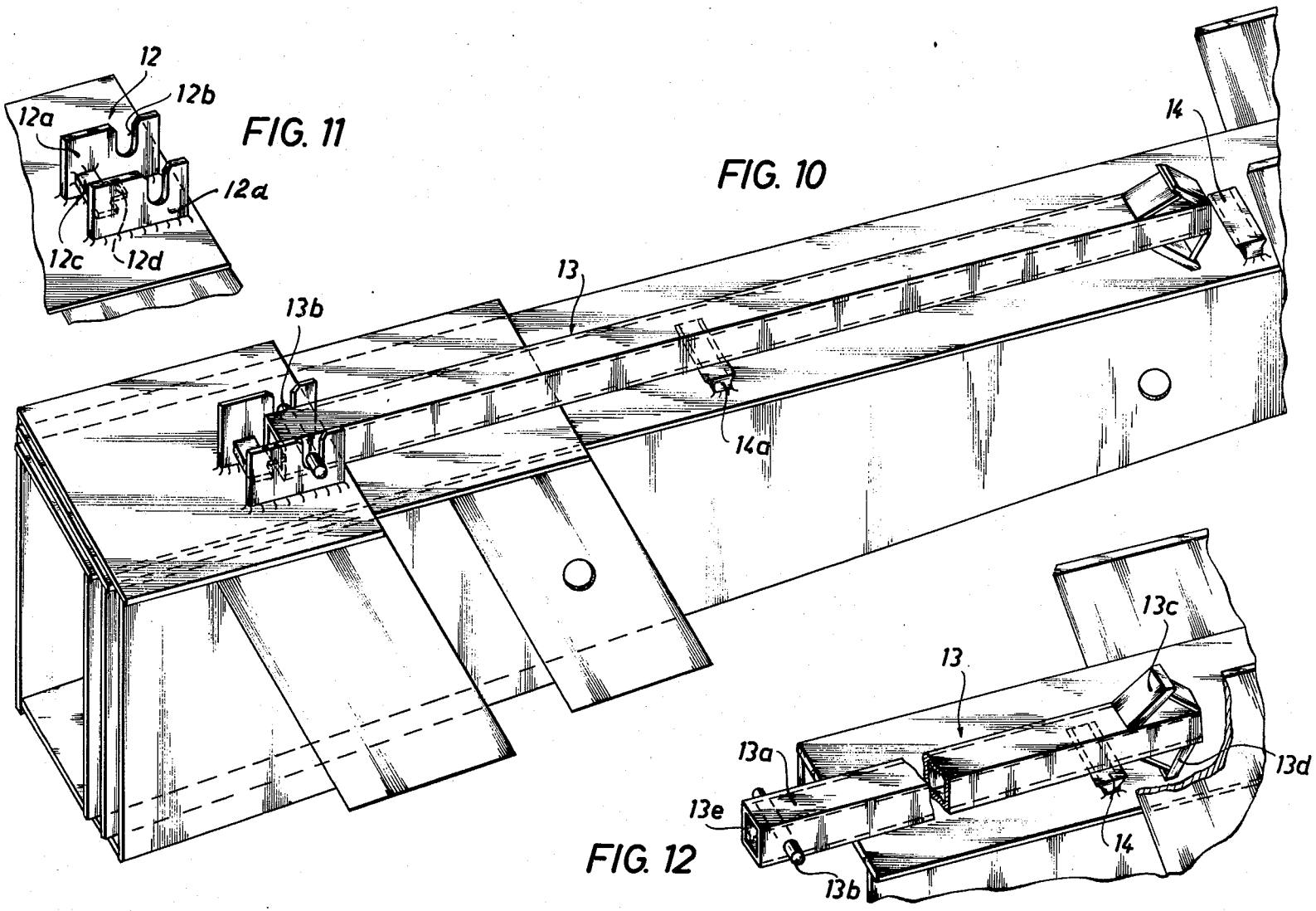
FIG. 10 shows an isometric view of the boom with built-in holding bar.
FIG. 11 illustrates the bearing for receiving the holding bar with locking latch.
FIG. 12 illustrates the holding bar for the inward movement of the mechanically operated telescopic slide with the holding bar turned by 180°.

Referring now to the drawings in detail, the telescopic boom 4 of a crane vehicle movable on rubber wheels 3 is pivotable in driving direction of said vehicle on an undercarriage 1 about a pivot bearing 2. The telescopic boom 4 comprises a base boom 5 and the telescopic slides 6, 7 and 8. The boom 4 is by means of a hydraulic cylinder piston system 9 pivoted about the pivot bearing 2 from the horizontal position which it occupies when being transported or from its rest position into the maximum upward position. The telescopic slide 6 is by means of the fixedly mounted hydraulic cylinder piston system 10, firmly journalled in the base boom 5, actuated for its outward and inward movement. The telescopic slide 7 is by means of the hydraulic cylinder piston system **10*a* displaceably connected to the telescopic slide 6. The hydraulically operated telescopic slide 7 and the mechanically operated telescopic slide 8 can by means of a bolt 11 be locked to each other. Firmly mounted on the telescopic slide 6 is a bearing 12 which serves for receiving a holding bar 13 (FIG. 3, FIG. 12) for moving the telescopic slide inwardly and outwardly. The bearing 12 (FIG. 11) comprises the two plates 12*a* which are welded to the telescopic slide 6 and which are provided with slots 12*b* while being interconnected by the web 12*c*. The holding bar 13 which cooperates with the bearing 12 comprises a box-shaped pipe 13*a*, a bolt 13*b* which is passed transversely through the holding bar 13, the holding bar 13 being hollow, and the bolt 13*b* being fixedly connected to bar 13; the holding bar 13 further comprises a pressure member 13*c* and a pulling member 13*d*, both members being welded to the holding bar 13. The top side of the mechanically operated slide 8 has firmly mounted thereon cams 14, 14*a*, 14*b* and 14*c* which are arranged transversely to the direction of outward movement. The cams serve as counter bearing for the holding bar 13, the pressure member 13*c* and the pulling member 13*d* of which catch behind the cams 14 to 14*c*. That end portion of the holding bar 13 which is provided with transverse bolt means 13*b* is provided with recess means 13*e* and the bearing means is provided with tongue means 12*d* for engaging the recess means 13*e*. The pushing member 13*c* and the pull member 13*d* form an angle of substantially 30° with the holding bar 13** while being so arranged thereto as to enable said holding bar to act as a push bar and as a pull bar.

Figure 1:
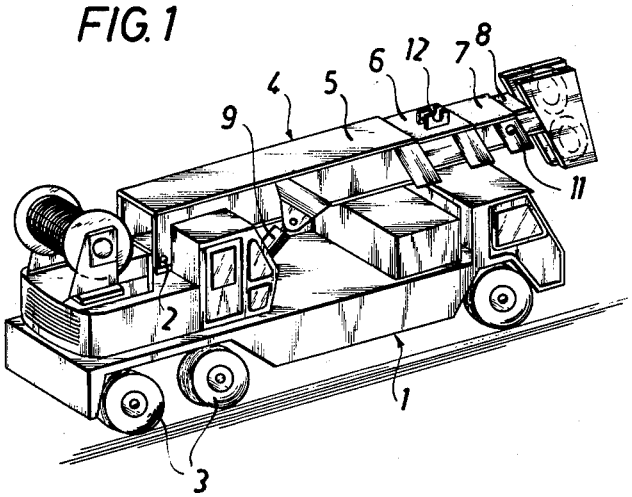
FIG. 1 is an isometric view of a crane vehicle with a telescopic boom according to the invention.
Figure 2:
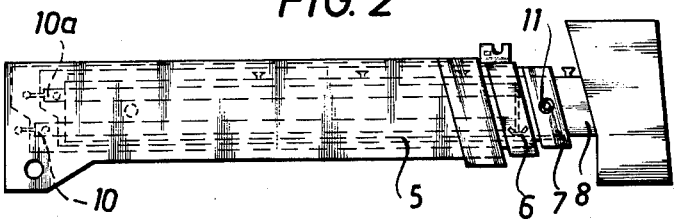
FIG. 2 shows a side view of the telescopic boom according to the invention in completely inwardly moved condition.
Figure 4:
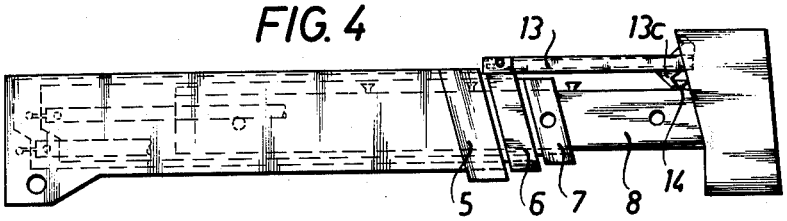
FIG. 4 shows the hydraulically operated telescopic slide in its retracted position with the first phase of the outward movement of the mechanically operated slide.
Figure 5:
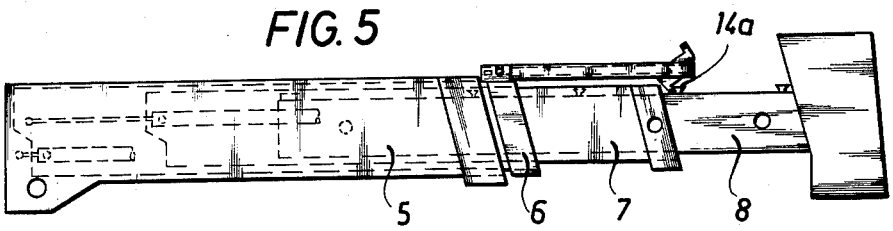
FIG. 5 shows the second phase of the outward movement of the mechanically operated telescopic slide.
Figure 6:
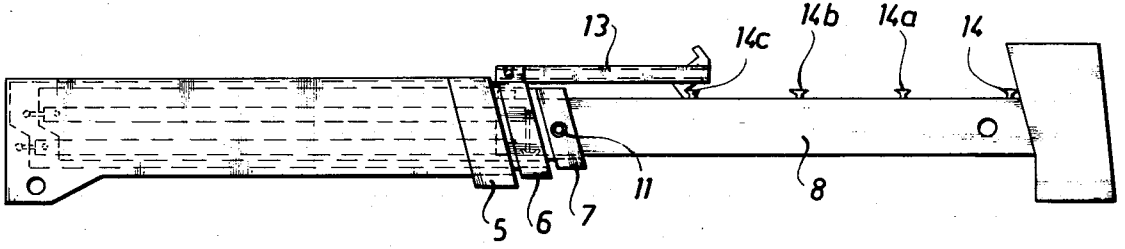
FIG. 6 shows the completely outwardly moved mechanically operated telescopic slide.
Figure 7:
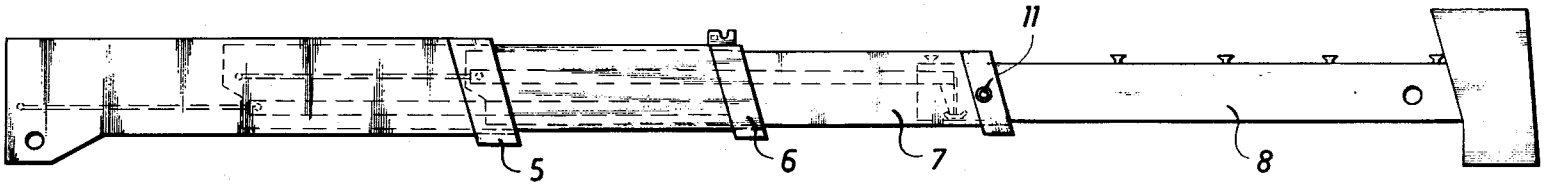
FIG. 7 illustrates the two hydraulically operated telescopic slides in partially moved out condition and the mechanically operated telescopic slide in its completely outwardly moved condition.
Figure 8:
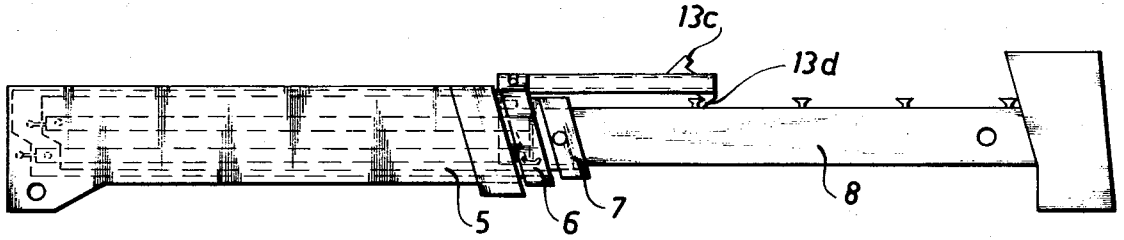
FIG. 8 shows the mounting of the holding bar for making possible the inward stroke of the completely outwardly moved mechanically operated telescopic slide.
Figure 9:
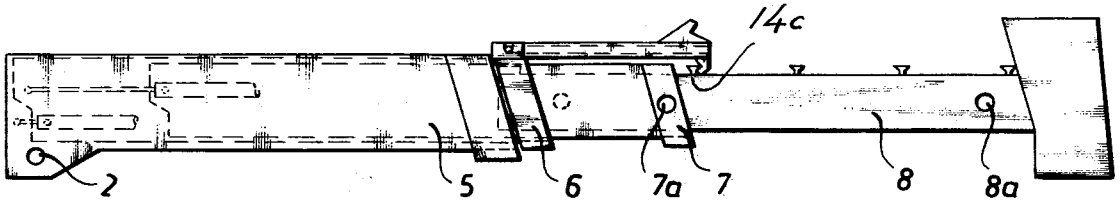
FIG. 9 shows the outwardly moved hydraulically operated telescopic slide with the first inward stage of movement of the mechanically operated telescopic slide.

The operation of the telescopic boom according to the present invention is as follows: When the telescopic boom 4 occupies its moved-in position, the mechanically operated telescopic slide 8 is by means of the bolt 11 non-displaceably connected to the hydraulically operated telescopic slide 7 (FIG. 2). By causing oil under pressure to act upon the telescopic slide 7, the latter is moved outwardly to such an extent that the holding bar 13 with the bolt 13*b* can be inserted into the slots 12*b* of the bearing 12 in front of the first cam 14. Thereupon the bolt 11 is removed. Subsequently the telescopic slide 7 is hydraulically drawn back. The mechanically operated telescopic slide 8 remains in moved out condition and moves the next cam 14*a* into its working position (FIG. 4). By repeating the just described working step, namely by the hydraulic outward movement of the telescopic slide 7 until the pressure member 13*c* of the holding bar 13 abuts the cam 14*a* of the telescopic slide 8, and by the subsequent hydraulic pulling-in of the telescopic slide 7 by means of the hydraulic cylinder 10*a* (FIG. 5), the mechanically operated telescopic slide 8 is moved outwardly by a further distance. When, as a result of further working steps as above described, the telescopic slide 8 has reached its end position, the telescopic slides 7 and 8 are interconnected by the bolt 11 (FIG. 6). After removal of the holding bar 13, by hydraulically actuating the telescopic slides 6 and 7, there is finally reached the maximum outward movement of the telescopic boom (FIG. 7). The inward movement of the mechanically operated telescopic slide 8 is effected inversely to the above described operation. The holding bar 13 is to this end turned by 180° so that the pulling member 13*d* first catches behind the cam 14*c* (FIGS. 8 and 9). The pulling member 13*d* will then during the successive actuation of the hydraulic cylinder 10*a* successively catch behind the cams 14*b*, 14*a* and 14 until the bore 7*a* of the telescopic slide 7 registers with the bore 8*a* of the telescopic slide 8 so that the bolt 11 can be passed through these bores whereby the telescopic slides 7 and 8 will be non-displaceably connected to each other.

It is, of course, to be understood that the present invention is, by no means, limited to the specific showing in the drawings but also comprises any modifications within the scope of the appended claims.

What we claim is:

1. A telescopic boom for movable cranes, which includes in combination: at least one hydraulically displaceable telescopic slide, bearing means connected to said hydraulically displaceable slide, at least one mechanically displaceable telescopic slide, a holding bar for operatively pushing out and retracting said at least one mechanically displaceable telescopic slide, said holding bar having a free end portion with a pushing member and with a pulling member offset by 180° with regard to said pushing member, said holding bar having its other end portion provided with transverse bolt means for engagement with said bearing means, and multiple dovetail-shaped cam means connected transversely to direction of actuation of said at least one mechanically displaceable telescopic slide and spaced from each other in the axial direction of said at least one mechanically displaceable telescopic slide.

2. A telescopic boom for movable cranes, which includes: at least one hydraulically displaceable telescopic slide, bearing means connected to said hydraulically displaceable slide, at least one mechanically displaceable telescopic slide, a holding bar for pushing out and retracting said at least one mechanically displaceable telescopic slide, said holding bar having a free end portion with a pushing member and with a pulling member offset by 180° with regard to said pushing member, said holding bar having its other end portion provided with transverse bolt means for engagement with said bearing means, and cam means connected to said at least one mechanically displaceable telescopic slide and spaced from each other in the axial direction of said at least one mechanically displaceable telescopic slide, that end portion of said holding bar which is provided with said transverse bolt means being provided with recess means, and said bearing means being provided with tongue means for engaging said recess means.

3. A telescopic boom according to claim 2, in which said pushing member and said pulling member form an angle of substantially 30° with said holding bar while being so arranged thereto as to enable said holding bar to act as push bar and as pull bar.

* * * * *